US006178854B1

(12) United States Patent
Shih

(10) Patent No.: US 6,178,854 B1
(45) **Date of Patent: *Jan. 30, 2001**

(54) SOCKET SPANNER PROVIDED WITH RETAINING DEVICE

(76) Inventor: Leo Shih, No5, Lane 54, San Min Rd., Sec. 3, Taichung (TW)

( * ) Notice: Under 35 U.S.C. 154(b), the term of this patent shall be extended for 0 days.

This patent is subject to a terminal disclaimer.

(21) Appl. No.: 09/122,593

(22) Filed: Jul. 25, 1998

(51) Int. Cl.[7] ..... B25B 13/02
(52) U.S. Cl. ..... 81/125
(58) Field of Search ..... 81/125, 451, 452, 81/180.1

(56) References Cited

U.S. PATENT DOCUMENTS 3,665,791 * 5/1972 Carr ..... 81/125
3,834,253 * 9/1974 Carr ..... 81/125
4,787,278 * 11/1988 Bononi ..... 81/125

* cited by examiner

*Primary Examiner*—David A. Scherbel
*Assistant Examiner*—Joni B. Danganan
(74) *Attorney, Agent, or Firm*—W. Wayne Liauh

(57) ABSTRACT

A socket spanner is provided with a socket having a driven end which is provided in the inner wall thereof with two retaining diagonally opposing each other. The driven end is further provided with an elastic body fitted thereinto such that two retaining sides of the elastic body are securely retained in the two retaining grooves of the driven end of the socket, and that a protruded edge of the retaining sides of the elastic body is capable of holding securely a nut which is engaged with the fitting end of the socket.

7 Claims, 9 Drawing Sheets

SOCKET SPANNER PROVIDED WITH RETAINING DEVICE

FIELD OF THE INVENTION

The present invention relates generally to a socket spanner, a socket spanner provided with a nut retaining device.

BACKGROUND OF THE INVENTION

As shown in FIG.1,the U.S. pat. application Ser. No.08/672,859 filed by this inventor as the same as the present invention discloses a socket 20 having a driven end 22 which is provided in the inner wall thereof with two grooves 221 diagonally opposing each other. The driven end 22 is further provided in proximity of one end thereof with a circular slot 222.An elastic body 24 is fitted into the fitting end 22 of the socket 20 such that a retaining side 241 of the elastic body 24 is retained in the grooves 221 of the fitting end 22,and that a curved end portion 244 of the elastic body 24 urges against the circular slot 222 of the driven end 22. As a result, a protruded edge 242 of the retaining side 241 of the elastic body 24 is capable of retaining a nut which is engaged with the driven end 22 of the socket 20.In the meantime, the retaining side 241 is capable of preventing the elastic body 24 from slipping out of the socket 20 at the time when the nut is taken out of the socket 20. The elastic body 24 is further provided with a bottom portion 243 having an arcuate configuration.

As shown in FIG.2, the U.S. pat. application Ser. No.08/998,686 filed by this inventor of the present invention discloses a socket spanner with a nut retaining device which is intended to overcome the structural deficiency of the socket spanner disclosed in the afore-mentioned U.S. pat. application Ser. No.08/672,859 and is composed of a circular slot 222 located in the bottom of the driven end of the socket. The elastic body is thus fitted into the driven end such that the arcuate bottom portion 243 of the elastic body is retained in the circular slot 222 so as to facilitate the removing of the nut which is engaged with the fitting end of the socket.

The socket spanners disclosed in the U.S. pat. application Ser. Nos.08/672,859 and 08/998,686 share a common structural deficiency in that they are provided with a circular slot 222 which can not be easily lathed with precision.

SUMMARY OF THE INVENTION

The primary objective of the present invention is therefore to provide a socket spanner with a nut retaining device free from the shortcomings of the prior art devices described above.

In keeping with the principle of the present invention, the foregoing objective of the present invention is attained by a socket spanner provided with a socket having a driven end which is provided in the inner wall thereof with two diagonally opposing each other. The driven end is further provided with an elastic body fitted securely thereinto such that two retaining sides of the elastic body are securely retained in the two retaining grooves of the driven end of the socket.

The foregoing objective, features, functions, and advantages of the present invention will be more readily understood upon a thoughtful deliberation of the following detailed description of the embodiments of the present invention with reference to the accompanying drawings.

FIGS .7–9 shows exploded views of the embodiments of the present invention.

DETAILED DESCRIPTION OF THE EMBODIMENTS

Figure 1:
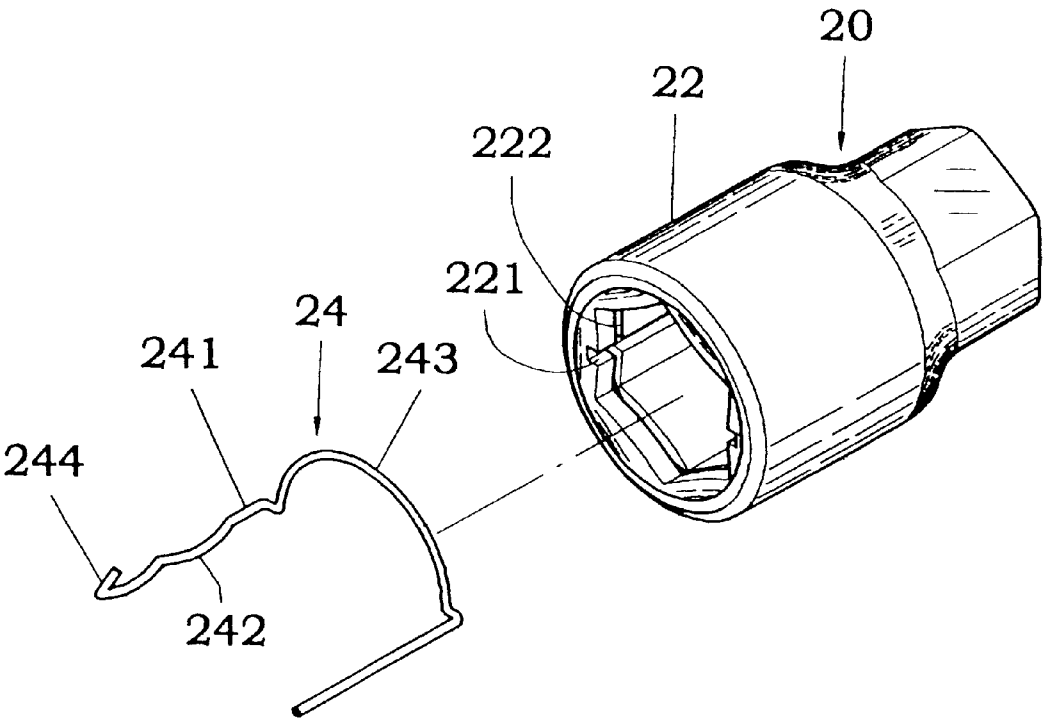
Fig. 1 PRIOR ART
FIG. 1 shows an exploded view of a socket spanner of the prior art.
Figure 2:
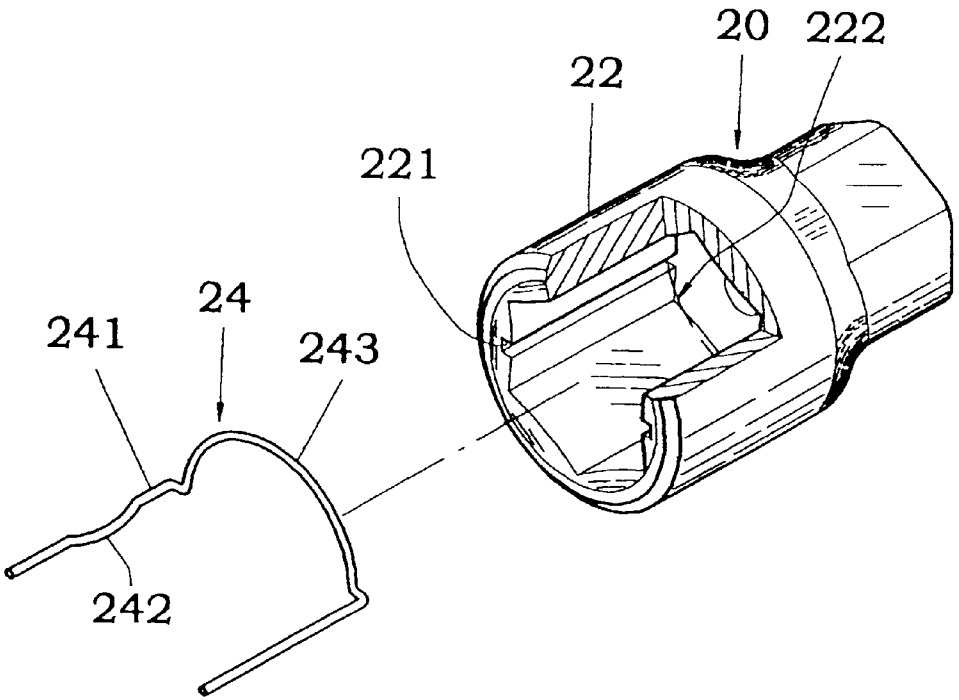
Fig. 2 PRIOR ART
FIG.2. shows an exploded view of another socket spanner of the prior art.
Figure 3:
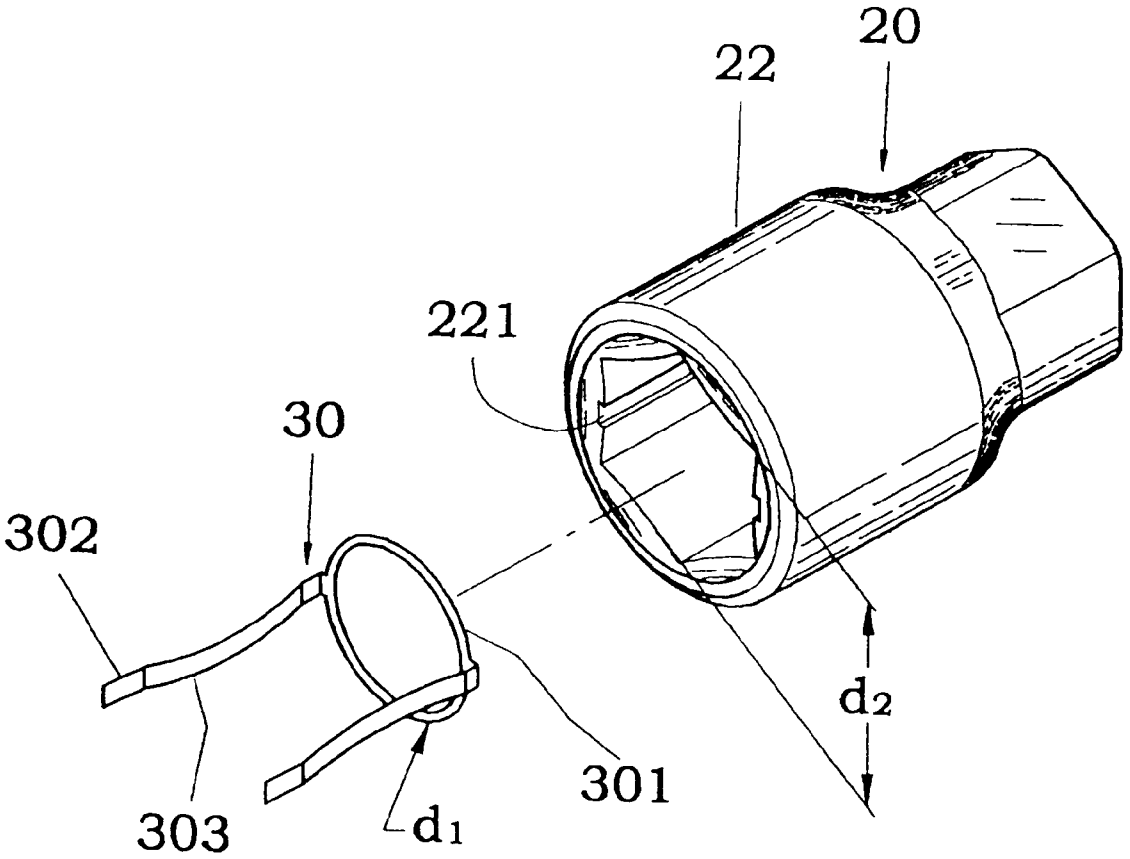
FIG.3 shows an exploded view of the present invention.
Figure 4:
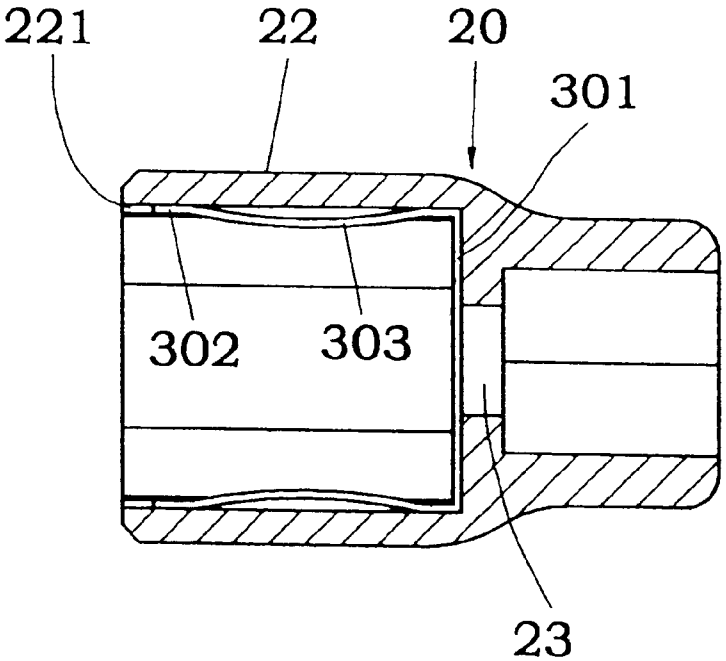
FIG.4 shows a sectional schematic view of the present invention.
Figure 5:
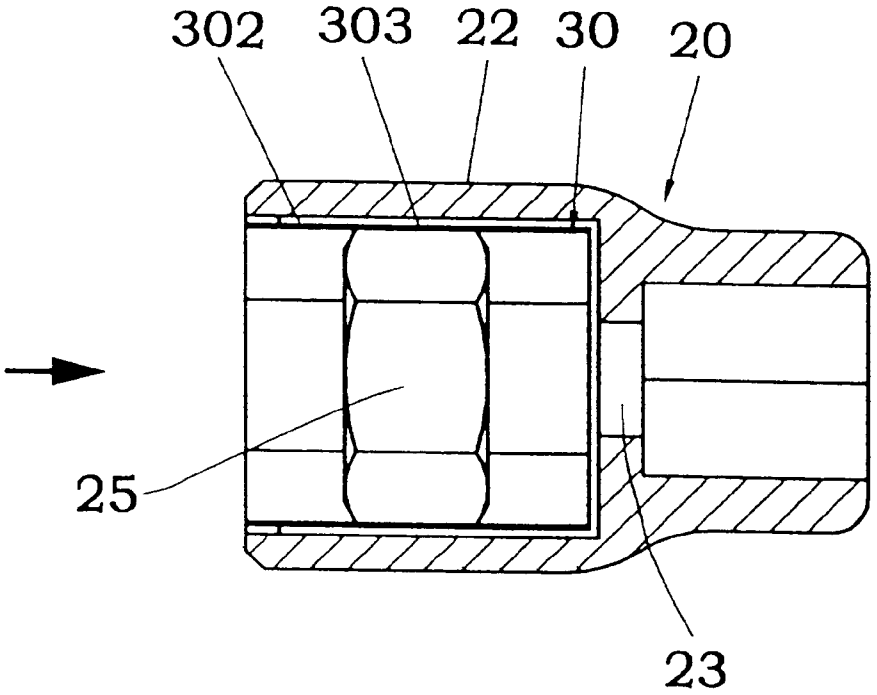
FIG.5 shows a schematic view of the present invention at work.
Figure 6:
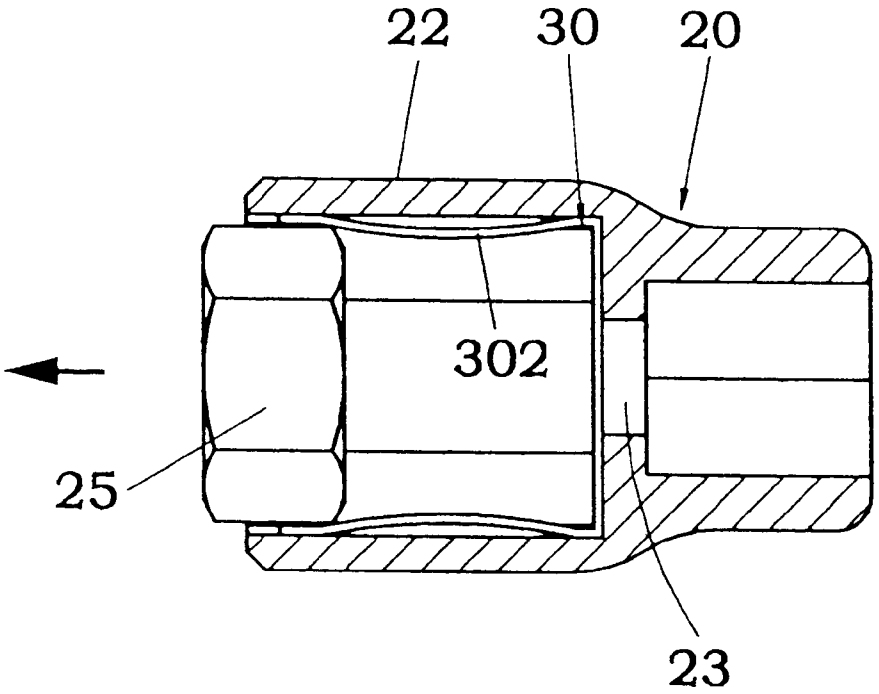
FIG.6 shows another schematic view of the present invention at work.

As shown in FIGS.3 and 4,a socket 20 of the socket spanner of the present invention has a driven end 22 which is provided in the inner wall thereof with two retaining grooves 221 diagonally opposing each other. The driven end 22 is further provided with an elastic body 30 fitted thereinto. The elastic body 30 is composed of a press portion 301 of a ring-shaped construction, and two retaining sides 302 extending in the same direction from the press portion 301.The retaining sides 302 have a protruded edge 303. The press portion 301 has an outer diameter, d1, which is slightly greater than a distance, d2,between two opposite inner side walls of a hexagonal hole of the driven end 22.The elastic body 30 is forced into the driven end 22 such that the retaining sides 302 of the elastic body 30 are securely retained in the retaining grooves 221 of the fitting end 22,and that the protruded edge 303 is capable of holding securely a nut 25 which is engaged with the driven end 22,as illustrated in FIG.5.In view of the fact that the retaining sides 302 of the elastic body 30 are securely retained in the retaining grooves 221 of the driven end 22,the elastic body 30 is prevented from slipping out of the driven end 22 at the time when the nut 25 is taken out of the fitting end 22,as illustrated in FIG.6.It must be noted here that the elastic body 30 is constructed in such a way that the elastic body 30 does not obstruct the center hole 23 of the socket 20.

Figure 8:
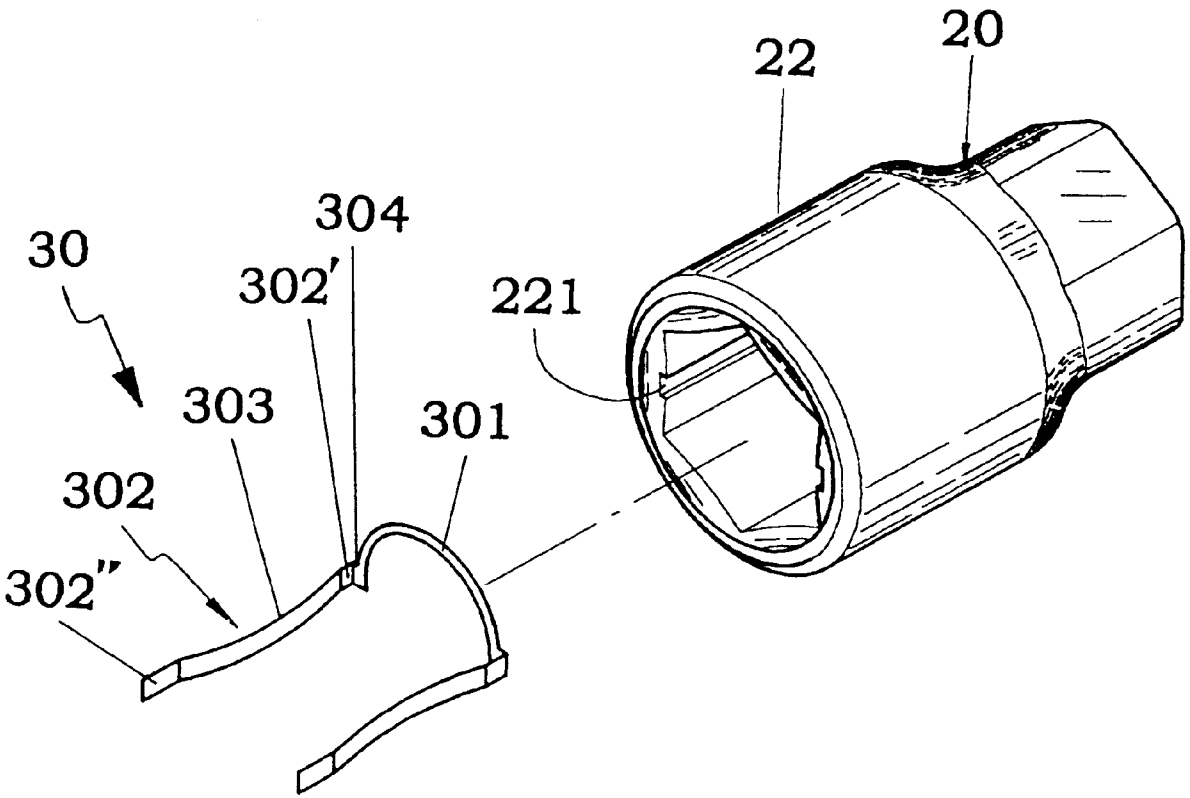

FIG. 8 also shows that the retaining leg is made of a thin strip having a width substantially greater than its thickness. The retaining leg 302 comprises a bent portion 304, a first straight portion 302", a second straight portion 302', and a radially inwardly protruding portion 303. The bent portion 304 connects the retaining leg with the press portion 301'.

Figure 7:
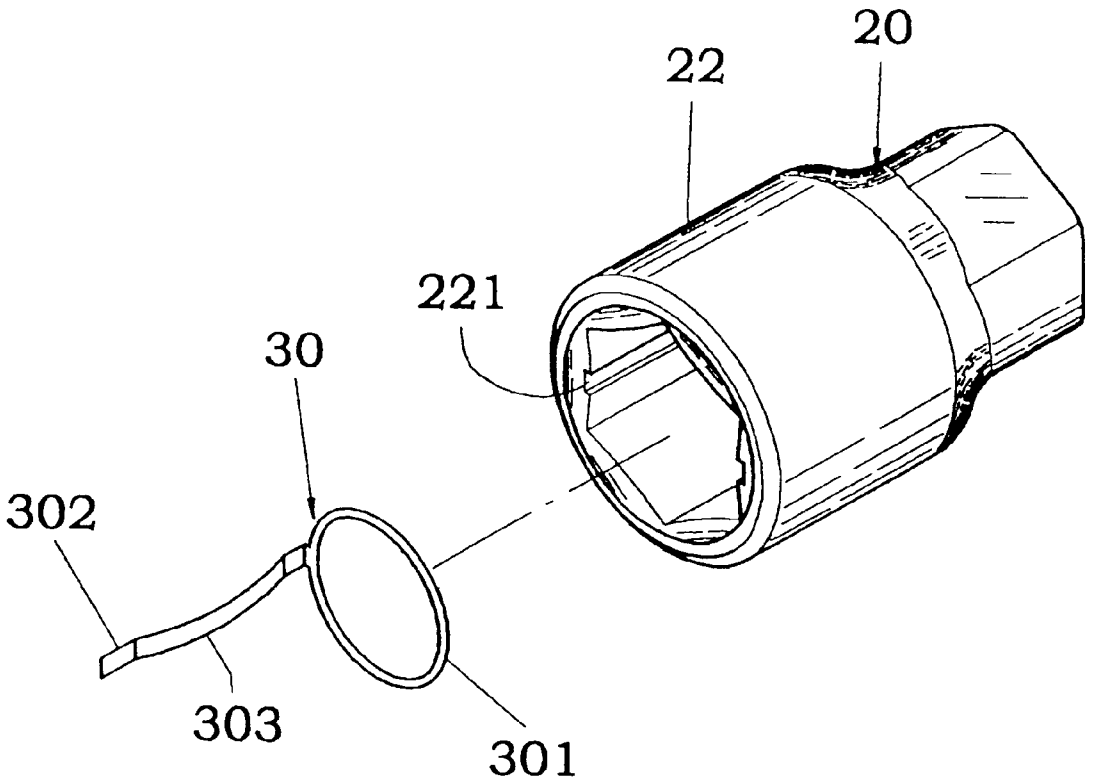
Figure 9:
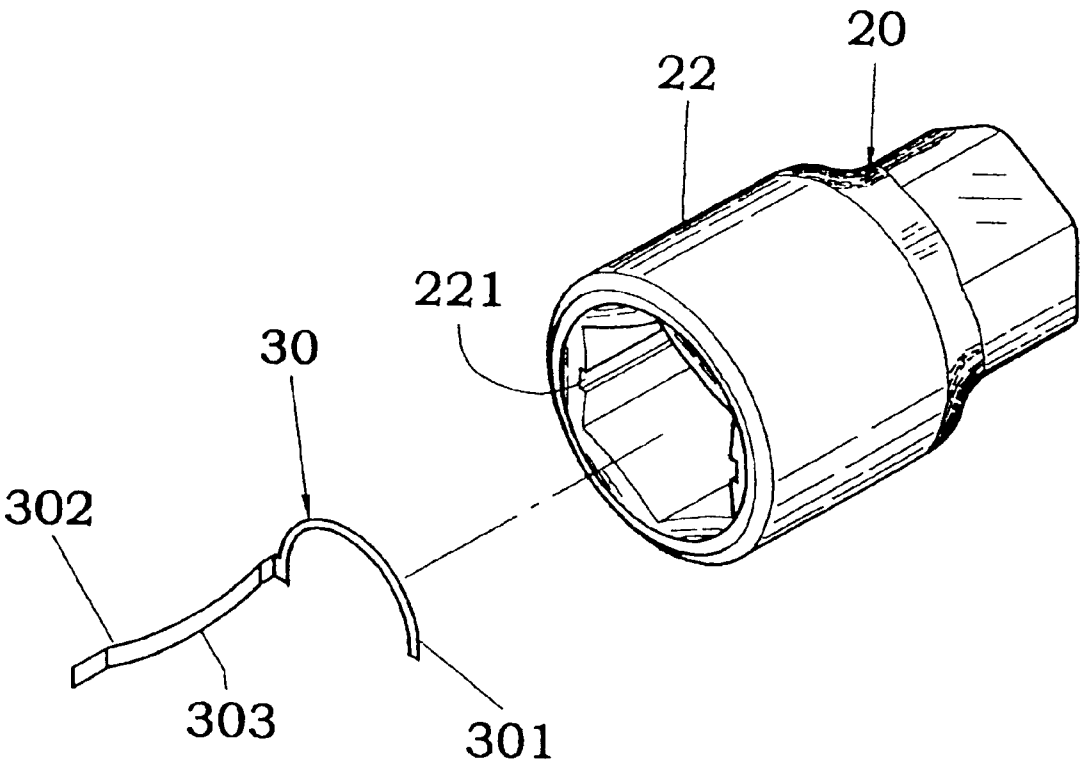

The embodiment of the present invention described above is to be deemed in all respects as being merely illustrative and not restrictive. Accordingly, the present invention may be embodied in other specific forms without deviating from the spirit thereof. For example, the elastic body 30 of the present invention may be modified in such a manner that the elastic body 30 is composed of only one retaining side 302 extending from the press portion 301 and having a protruded edge 303,as shown in FIG.7.In addition, the press portion 301 of a closed ring construction of the elastic body 30 may be modified to be of a semicircular construction, as shown in FIG.8.The elastic body 30 is thus composed of two retaining sides 302 extending from both ends of the semicircular press portion 301.The elastic body 30 shown in FIG.8 is further modified in such a way that the elastic body 30 is composed of only one retaining side 302 extending from one end of the semicircular press portion 301,as shown in FIG.9.The present invention is therefore to be limited only by the scopes of the following appended claims.

What is claimed is:

1. A socket spanner with a retaining device comprising a socket and an elastic body;

wherein said socket has a driven end with a hexagonal hole which is provided in an inner wall thereof with two axially extending retaining grooves in substantially diagonally opposing positions relative to each other;

said elastic body comprising a press portion and at least one longitudinally extending retaining leg which extends from said press portion;

said press portion having a full-ring configuration with a diameter slightly greater than a distance between two opposing faces of said hexagonal hole so as to allow said elastic body to be received and retained in said hexagonal hole;

said retaining leg comprising a bent portion, a first straight portion, a second straight portion, and a radially inwardly protruding portion, all of said portions being receivable in said retaining groove, said bent portion connecting said retaining leg with said press portion, said first and second portions being generally parallel to an inside surface of said retaining groove, and said radially inwardly protruding portion being disposed between said first and second straight portions which is constructed to be pressed into said groove and exert an urging against a nut when the nut is inserted into said hexagonal hole.

2. The socket spanner as defined in claim 1, wherein said elastic body comprises only one retaining leg extending from said press portion.

3. The socket spanner as defined in claim 1, wherein said press portion of said elastic body comprises only one retaining leg extending from said press portion.

4. The socket spanner as defined in claim 1, wherein said elastic body comprises a pair of said retaining legs disposed diagonally opposing each other.

5. The socket spanner as defined in claim 1, wherein said bent portion of said retaining leg is structured so that said retaining leg exerts an urging force against an inner wall of said groove.

6. A socket spanner with a retaining device comprising a socket and an elastic body;

wherein said socket has a driven end with a hexagonal hole which is provided in an inner wall thereof with two axially extending retaining grooves in substantially diagonally opposing positions relative to each other;

said elastic body comprising a press portion and at least one longitudinally extending retaining leg which extends from said press portion;

said press portion having a half-ring configuration with a diameter slightly greater than a distance between two opposing faces of said hexagonal hole so as to allow said elastic body to be received and retained in said hexagonal hole;

said retaining leg comprising a bent portion, a first straight portion, a second straight portion, and a radially inwardly protruding portion, all of said portions being receivable in said retaining groove, said bent portion connecting said retaining leg with said press portion, said first and second portions being generally parallel to an inside surface of said retaining groove, and said radially inwardly protruding portion being disposed between said first and second straight portions which is constructed to be pressed into said groove and exert an urging against a nut when the nut is inserted into said hexagonal hole.

7. The socket spanner as defined in claim 6, wherein said elastic body comprises only one retaining leg extending from said press portion.

* * * * *